US009314120B2

(12) United States Patent
Kemper et al.

(10) Patent No.: US 9,314,120 B2
(45) Date of Patent: Apr. 19, 2016

(54) CUP AND LID ASSEMBLY FOR A CUP

(75) Inventors: Bernard J. Kemper, Bonne Terre, MO (US); Charles H. Miller, Barnhart, MO (US)

(73) Assignee: Handi-Craft Company, St. Louis, MO (US)

( * ) Notice: Subject to any disclaimer, the term of this patent is extended or adjusted under 35 U.S.C. 154(b) by 269 days.

(21) Appl. No.: 12/879,470

(22) Filed: Sep. 10, 2010

(65) Prior Publication Data

US 2011/0062170 A1 Mar. 17, 2011

Related U.S. Application Data

(60) Provisional application No. 61/241,640, filed on Sep. 11, 2009.

(51) Int. Cl.
*A47G 19/22* (2006.01)
*B65D 25/48* (2006.01)
*B65D 47/20* (2006.01)

(52) U.S. Cl.
CPC ..... *A47G 19/2266* (2013.01); *B65D 25/48* (2013.01); *B65D 47/2043* (2013.01)

(58) Field of Classification Search
USPC ..... 220/708, 711, 254.8, 259.3, 259.4, 253
See application file for complete search history.

(56) References Cited

U.S. PATENT DOCUMENTS

| | | | | |
|---|---|---|---|---|
| 3,294,293 | A | | 12/1966 | Johns |
| 3,337,098 | A | | 8/1967 | Johns |
| 4,183,443 | A | | 1/1980 | DeParales et al. |
| 4,441,640 | A | | 4/1984 | Lottick |
| 4,448,316 | A | | 5/1984 | Hiroshige |
| 4,684,032 | A | | 8/1987 | Tsay |
| 4,726,479 | A | | 2/1988 | Tsai |
| 4,852,762 | A | | 8/1989 | Chou-Sheng |
| 4,925,040 | A | | 5/1990 | Wang |
| D315,103 | S | | 3/1991 | Bennett |
| 5,065,909 | A | | 11/1991 | Pino et al. |
| 5,150,815 | A | * | 9/1992 | Saklad ..... 220/708 |
| 5,188,283 | A | | 2/1993 | Gu |
| 5,203,468 | A | | 4/1993 | Hsu |
| 5,203,841 | A | | 4/1993 | Kitabayashi |
| 5,259,538 | A | | 11/1993 | Tardif |
| 5,265,757 | A | | 11/1993 | Wu |
| 5,273,172 | A | | 12/1993 | Rossbach et al. |
| 5,282,541 | A | | 2/1994 | Chen |
| 5,337,918 | A | | 8/1994 | Wang |
| 5,339,982 | A | | 8/1994 | Tardie |
| 5,346,081 | A | | 9/1994 | Lin |

(Continued)

FOREIGN PATENT DOCUMENTS

WO 2005097612 A1 10/2005

OTHER PUBLICATIONS

International Search Report & Written Opinion for PCT/US2010/048426, dated Oct. 25, 2010.

(Continued)

*Primary Examiner* — Jeffrey Allen
(74) *Attorney, Agent, or Firm* — Armstrong Teasdale LLP

(57) ABSTRACT

A lid assembly for a cup is releasably attachable to a container. The lid assembly includes a closure member and a cover secured to the closure member. The cover is capable of rotating in a clockwise direction and a counter-clockwise direction relative to the closure member while the cover is secured to the closure member.

14 Claims, 19 Drawing Sheets

(56) References Cited

U.S. PATENT DOCUMENTS

| | | | | |
|---|---|---|---|---|
| 5,361,934 | A | 11/1994 | Spence, Jr. | |
| 5,423,476 | A | 6/1995 | Ferrer | |
| D364,071 | S | 11/1995 | Lynd | |
| 5,465,866 | A | 11/1995 | Belcastro | |
| 5,477,994 | A | 12/1995 | Feer et al. | |
| 5,484,080 | A | 1/1996 | Blasnik et al. | |
| D366,809 | S | 2/1996 | Green | |
| D367,206 | S | 2/1996 | Green | |
| 5,497,901 | A | 3/1996 | Chen | |
| 5,518,142 | A | 5/1996 | Lin | |
| 5,518,143 | A | 5/1996 | Iodice | |
| 5,520,304 | A | 5/1996 | Lin | |
| D370,828 | S | 6/1996 | Green | |
| D371,048 | S | 6/1996 | Green | |
| D372,866 | S | 8/1996 | Ahern, Jr. | |
| 5,579,948 | A * | 12/1996 | Lin | 220/707 |
| 5,582,320 | A | 12/1996 | Lin | |
| D382,170 | S | 8/1997 | Green | |
| D384,584 | S | 10/1997 | Kong | |
| D406,006 | S | 2/1999 | Hatsumoto et al. | |
| 5,884,793 | A | 3/1999 | Wang | |
| D408,220 | S | 4/1999 | Chomik | |
| 5,897,013 | A | 4/1999 | Manganiello | |
| 5,908,126 | A | 6/1999 | Wang | |
| 6,050,433 | A | 4/2000 | Russell et al. | |
| 6,116,446 | A | 9/2000 | Haughton et al. | |
| 6,116,458 | A | 9/2000 | Dark | |
| 6,196,413 | B1 | 3/2001 | Tung | |
| D447,004 | S | 8/2001 | Green | |
| 6,276,560 | B1 | 8/2001 | Belcastro | |
| 6,279,773 | B1 | 8/2001 | Kiyota | |
| D448,971 | S | 10/2001 | Hughes | |
| 6,375,019 | B1 | 4/2002 | Hirota et al. | |
| D457,384 | S | 5/2002 | Randolph | |
| RE37,773 | E | 7/2002 | Trombley | |
| 6,427,928 | B1 | 8/2002 | Hirota et al. | |
| 6,494,332 | B1 | 12/2002 | Haughton et al. | |
| 6,523,711 | B1 | 2/2003 | Hughes et al. | |
| 6,550,631 | B2 | 4/2003 | Thompson | |
| 6,595,822 | B1 | 7/2003 | Thai | |
| 6,609,624 | B2 | 8/2003 | Goto et al. | |
| 6,619,518 | B1 | 9/2003 | Lee | |
| 6,638,131 | B1 | 10/2003 | Thai | |
| 6,745,949 | B2 | 6/2004 | Lee | |
| 7,059,490 | B2 | 6/2006 | Son | |
| 7,093,735 | B2 | 8/2006 | Stephens | |
| 7,097,065 | B2 | 8/2006 | Yoneoka et al. | |
| 7,124,907 | B2 | 10/2006 | Conaway | |
| 7,124,917 | B2 | 10/2006 | Lee | |
| D547,607 | S | 7/2007 | Forsman | |
| D548,008 | S | 8/2007 | Lin | |
| 7,255,241 | B2 | 8/2007 | Yoneoka et al. | |
| 7,371,004 | B1 | 5/2008 | Branson, III et al. | |
| 7,392,916 | B1 | 7/2008 | Kuighadush | |
| D604,565 | S | 11/2009 | Roth et al. | |
| D612,237 | S | 3/2010 | Richey | |
| 2004/0069783 | A1 | 4/2004 | Chen | |
| 2005/0029271 | A1 | 2/2005 | McDonough | |
| 2005/0133519 | A1 | 6/2005 | McDonough | |
| 2006/0255036 | A1 | 11/2006 | Chau | |
| 2006/0283859 | A1 * | 12/2006 | Lu | 220/253 |
| 2008/0099494 | A1 | 5/2008 | Boukais et al. | |
| 2008/0128417 | A1 | 6/2008 | Smith et al. | |
| 2008/0142519 | A1 * | 6/2008 | Chou | 220/253 |
| 2008/0237233 | A1 | 10/2008 | Choi et al. | |
| 2008/0277020 | A1 | 11/2008 | Windmiller | |
| 2011/0049169 | A1 * | 3/2011 | Rosnak et al. | 220/705 |

OTHER PUBLICATIONS

38TPD: 38mm Twist and Pull Cap, IEPC—Plastic Closure (Cap) Supplier, Jul. 10, 2006, web.archive.org/web/20060710083537/http://www.ipec.com/code/products_38TPD.asp?industry=Water.

Supplementary European Search Report dated Dec. 21, 2012 from corresponding EP Application No. 10816155.5.

* cited by examiner

CUP AND LID ASSEMBLY FOR A CUP

CROSS REFERENCE TO RELATED APPLICATION

This application claims the benefit of U.S. Provisional Application No. 61/241,640 filed Sep. 11, 2009, which is incorporated herein in its entirety.

FIELD

The field of this invention relates generally to cups and more particularly to a cup having a straw cup configuration and a drinking cup configuration.

BACKGROUND

Numerous types of straw cups are known. Typically, known straw cups include a container, a lid assembly selectively attachable to the container, and a straw assembly selectively attachable to the lid assembly. Often, the lid assembly is adapted to move the straw assembly between an operative position wherein the straw assembly is positioned for a user to drink from the cup, and a stowed position wherein the straw assembly is at least partially enclosed by the lid assembly and unavailable for the user to drink from the cup. In the stowed position, the straw assembly is commonly bent along its length about a relatively narrow fold line to thereby pinch the straw assembly closed to inhibit the cup from leaking liquid through the straw assembly. However, these types of closure arrangements are susceptible to leakage.

In addition, movement of the lid assembly to move the straw assembly between the operative and stowed positions often requires proper alignment of two or more components of the lid assembly. Thus, small children may have difficulty moving the lid assembly into proper alignment to correctly configure the straw assembly. When the child is moving the lid assembly to reposition the straw assembly from the stowed position to the operative position, misalignment of the lid assembly components may inhibit drinking from the cup (e.g., if the straw assembly remains partially bent). When the child is moving the lid assembly to reposition the straw assembly from the operative position to the stowed position, misalignment of the lid assembly components may prevent proper sealing of the straw assembly thereby increasing the likelihood the cup will leak liquid.

In known straw cup configurations, the lid assemblies are specifically adapted to be used with the straw assembly attached thereto. The structure and configuration of the lid assembly prevents or otherwise inhibits a user from drinking from the cup without the straw assembly properly attached to the lid assembly. Thus, known straw cup configurations are adapted to be used only when the straw assembly is attached to the lid assembly.

SUMMARY

In one aspect, a lid assembly for closing a drinking container generally comprises a closure member and a cover secured to the closure member. The cover is capable of rotating in a clockwise direction and a counter-clockwise direction relative to the closure member while the cover is secured to the closure member.

In another aspect, a lid assembly for closing a drinking container generally comprises a closure member and a cover secured to the closure member. The cover includes an opening therein. The opening has a projected surface area that is more than one-forth but less than one-half of a projected surface area of the entire cover.

In yet another aspect, a lid assembly for closing a drinking container generally comprises a central axis, a closure member having a socket, and a cover having a post received in the socket. The post defines a pivot axis about which the cover can rotate with respect to the closure member. The pivot axis and the central axis are coaxial.

In still another aspect, a cup generally comprises a container having a liquid chamber adapted to contain liquid. A lid assembly is releasably attachable to the container for selectively closing the liquid chamber, and a straw assembly is releasably attachable to the lid assembly. The cup has a straw cup configuration wherein the straw assembly is attached to the lid assembly and a drinking cup configuration wherein the straw assembly is detached from the lid assembly and the lid assembly is attached to the container.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
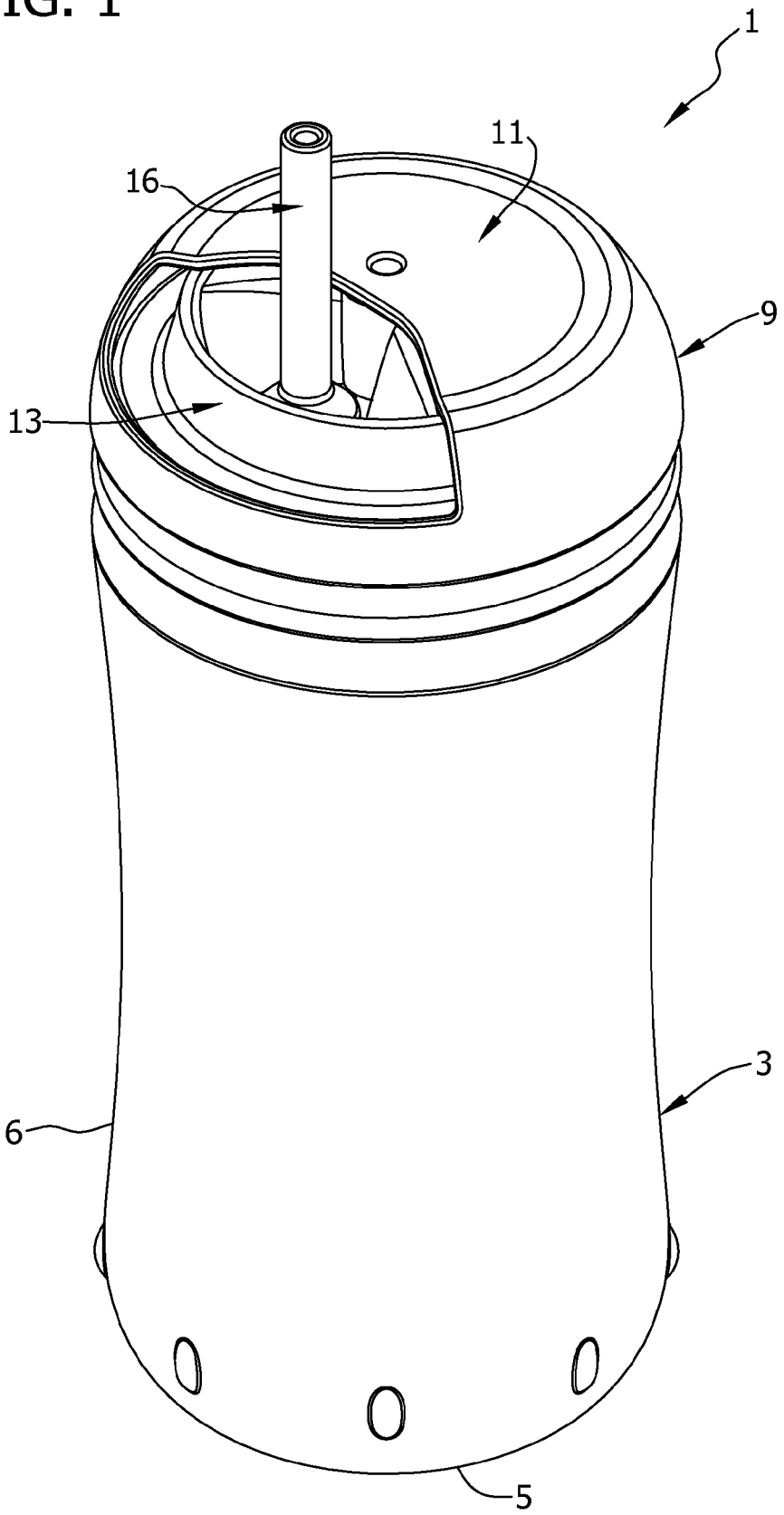
FIG. 1 is a perspective view of one embodiment of a cup having a container and a lid assembly attached to the container and configured for use as a straw cup.
Figure 2:
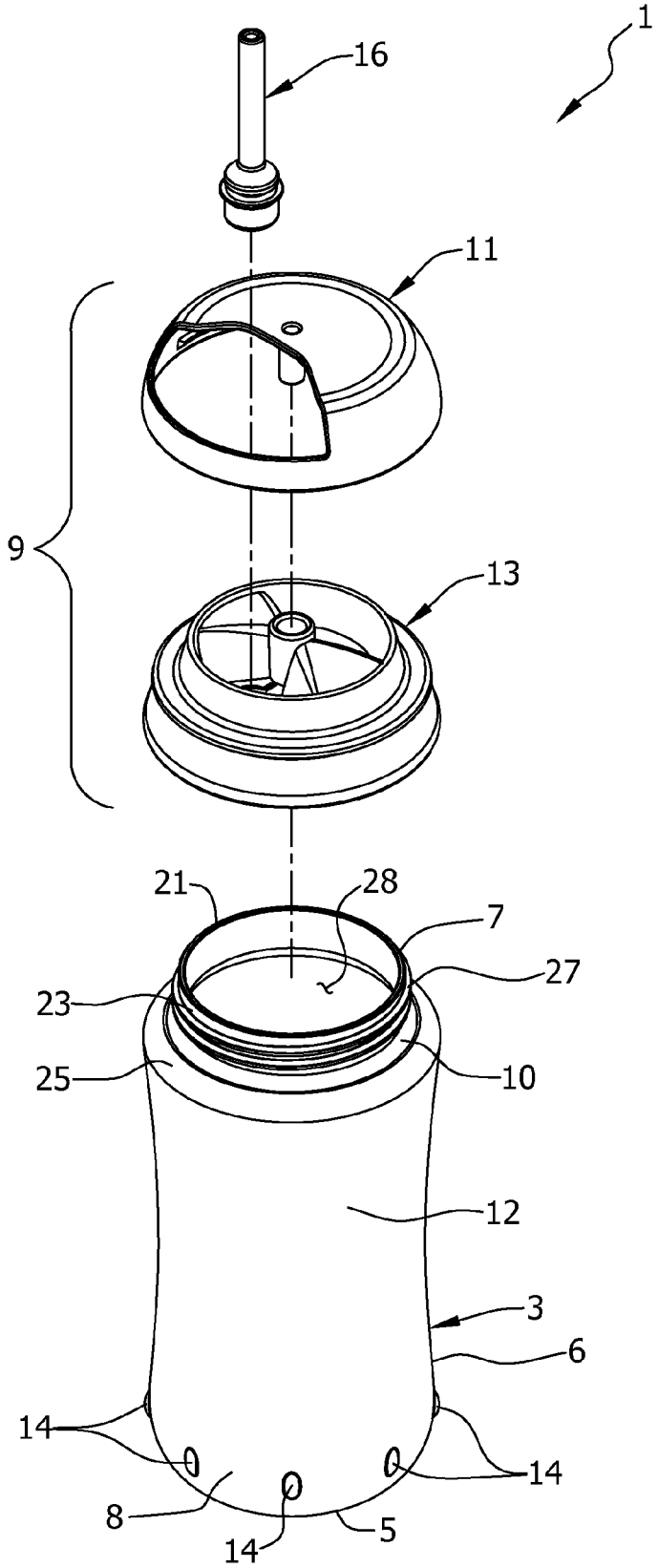
FIG. 2 is an exploded perspective view of the cup.
Figure 3:
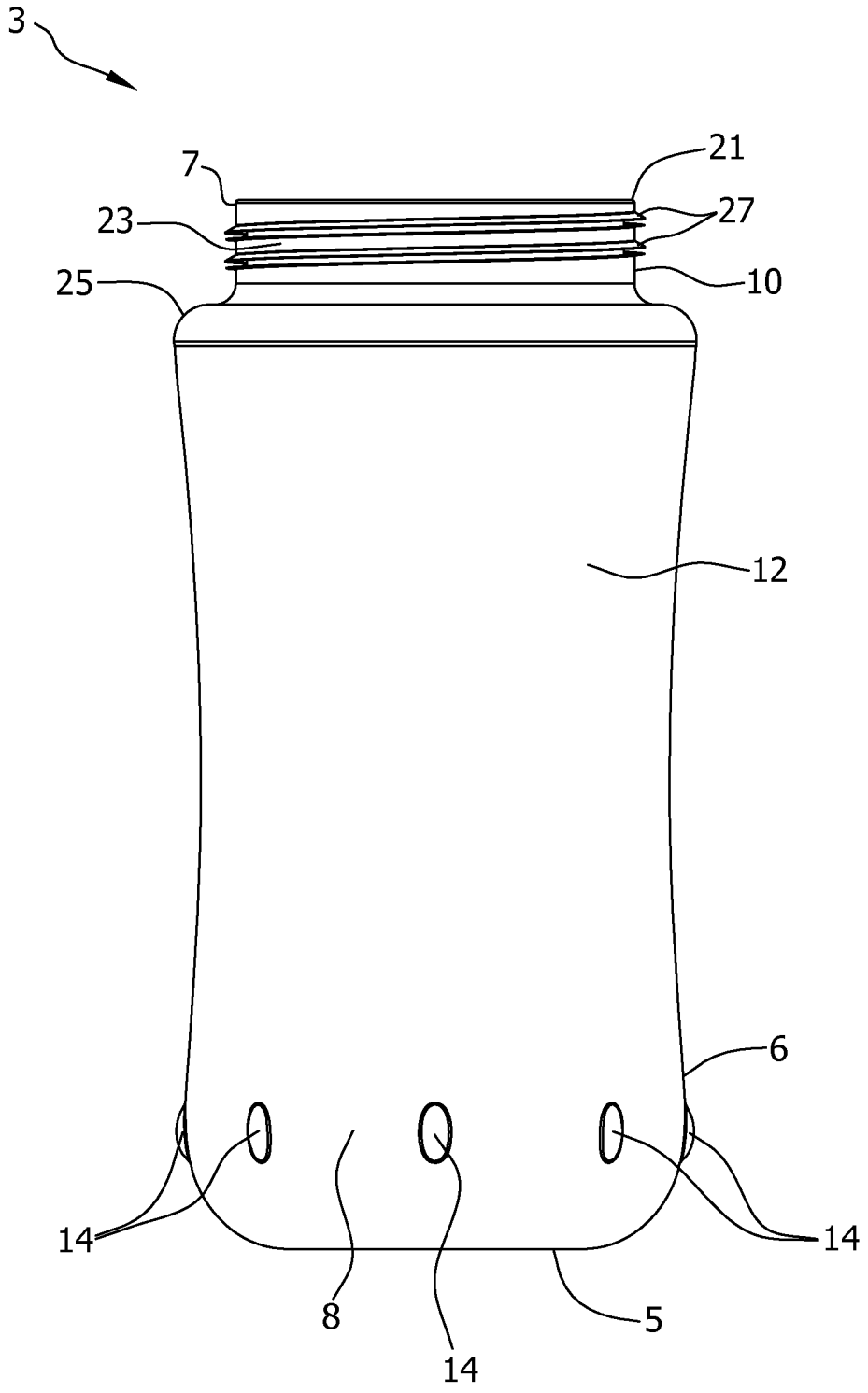
FIG. 3 is a side elevation of the container of the cup with the lid assembly removed therefrom.

Referring now to the drawings and in particular to FIGS. 1 and 2, a leak resistant cup, generally indicated at 1, includes a container, which is generally indicated at 3, a lid assembly, which is generally indicated at 9, and a straw assembly, which is generally indicated at 16. The illustrated container 3 is generally cylindrical and symmetric about a central axis. As best illustrated in FIGS. 2 and 3, the container 3 has a closed bottom 5, an open top 7, and a generally cylindrical side wall 6 extending between the closed bottom and the open top. The cylindrical side wall 6 includes a base portion 8, a top portion 10, and a concave middle portion 12 extending between the base and top portions. The middle portion 12 of the side wall 6 of the illustrated container 3 is concave to facilitate grasping of the container and thereby the cup 1. It is understood, however, that the middle portion 12 can be convex or generally straight. The base portion 8 of the side wall 6 includes a plurality of circumferentially spaced-apart nubs 14. The top portion 10 of the side wall 6 has a circular upper edge 21, an attachment collar 23 disposed beneath and adjacent to the upper edge, and a shoulder 25 disposed below the attachment collar. The attachment collar 23 has external threads 27 thereon.

The illustrated container 3 has a liquid chamber 28 adapted to hold a quantity of liquid for consumption by a user, such as a young child. More specifically, the illustrated container 3 is adapted to hold approximately 12 ounces of liquid. It is to be understood, however, that the cup 1 can be sized to hold other quantities of liquid (e.g., 6 ounces, 9 ounces, 20 ounces, 32 ounces etc.). For example, the container 3 can be adapted for older children or adults and hold larger quantities of liquid. It is also understood that the container 3 can have a different configuration than the one illustrated herein, such as a sports bottle, a drink tumbler, a commuter cup, etc. The container 3 can be made of any suitable material such as, without limitation, polypropylene, aluminum, or stainless steel. The container 3 can also be made in any desired color or colors, and may be transparent, translucent, or opaque.

The lid assembly 9 of the cup 1 is adapted for removable attachment to the container 3 for selectively closing the open top 7 of the container. The lid assembly 9, as illustrated in FIG. 2, comprises a cover 11 and a closure member 13. Both the cover 11 and closure member 13 are indicated generally by their respective reference numbers. The cover 11 and closure member 13 can be made of any suitable material. In one embodiment, the cover 11 and closure member 13, for example, can be made of polypropylene. The cover 11 and closure member 13 can be made in any desired color or colors, and may be transparent, translucent, or opaque.

Figure 4:
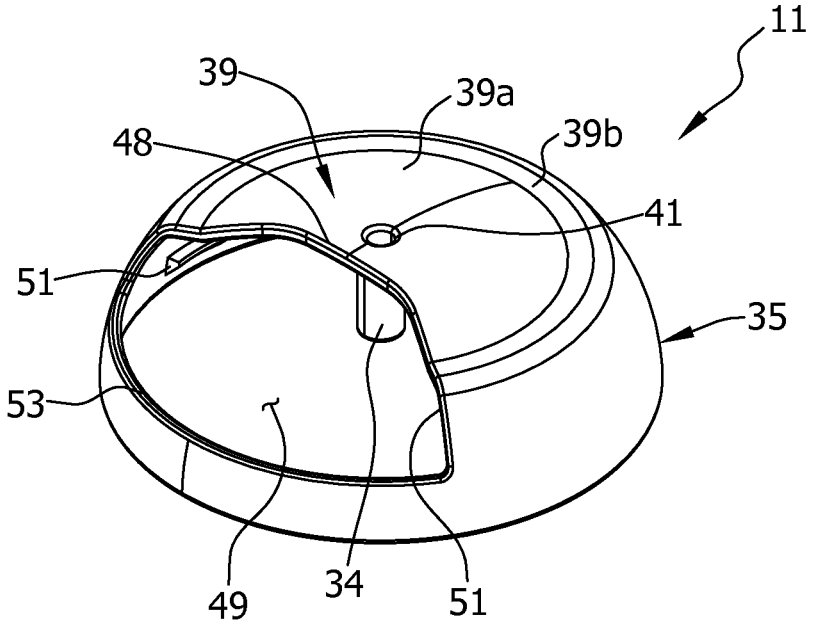
FIG. 4 is a perspective view of a cover of the lid assembly.
Figure 5:
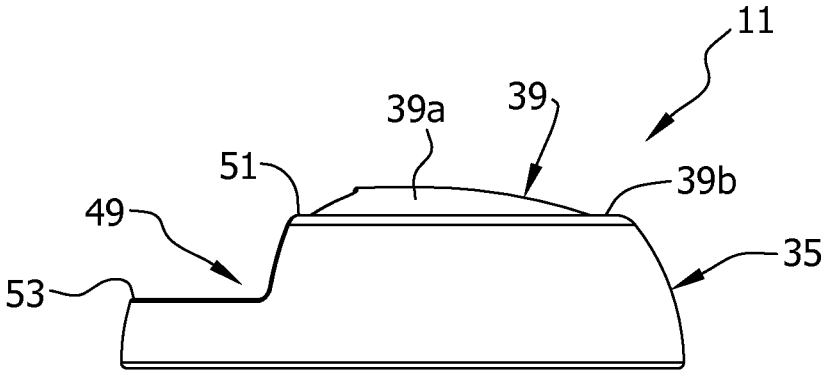
FIG. 5 is a side elevation of the cover.
Figure 6:
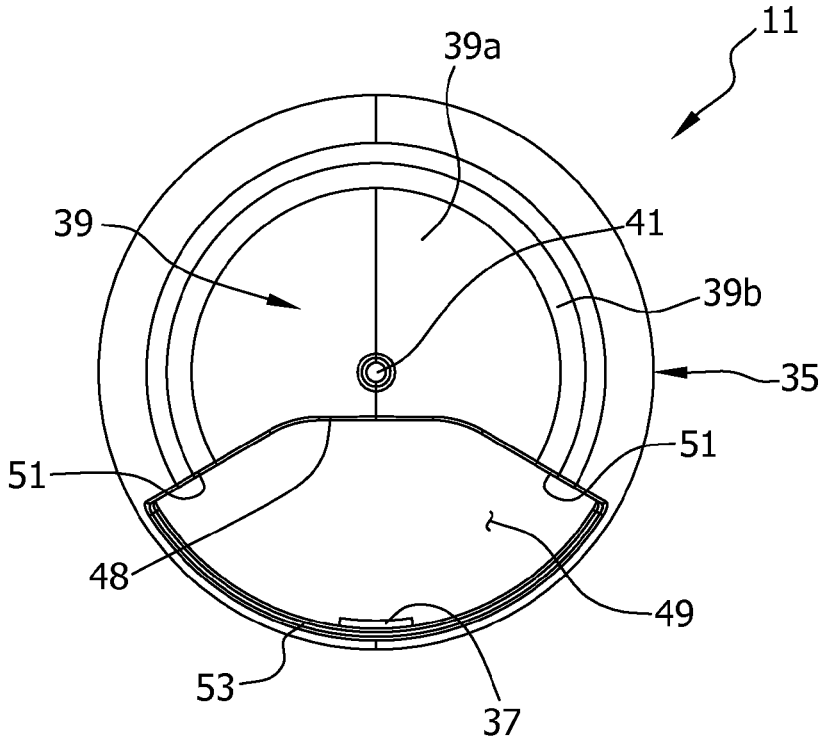
FIG. 6 is a top plan of the cover.

With reference now to FIGS. 4-7, the cover 11 of the lid assembly 9 includes an upper portion, indicated generally at 39, and a peripheral skirt, indicated generally at 35, depending downward from the upper portion. The upper portion 39 includes a slightly domed part 39*a* and a generally flat, annular part 39*b* surrounding the domed part. As seen in FIGS. 4 and 6, a relatively small, generally circular recess 41 is located in the center of the domed part 39*a*. The recess 41, however, can have any suitable shape or can be omitted.

A relatively large opening 49 extends through the upper portion 39 and the peripheral skirt 35. In the illustrated embodiment, the opening 49 is defined by a first generally straight edge segment 48 generally tangential to the central recess 41, a pair of second edge segments 51 that extend outward and downward from the first edge segment, and a third generally semi-circular edge segment 53 extends between and connects the two second edge segments. Each of the second edge segments 51 slopes downward and at an angle between the first edge segment 48 and third edge segment 53 (FIG. 4). As a result and as seen in FIG. 5, the third semi-circular edge segment 53 is spaced outward from the first edge segment 48 and lies in a plane that is lower than a plan in which the first edge segment lies.

In the illustrated embodiment, the opening 49 is relatively large. That is, the opening 49 occupies a generally large portion in the cover 11. In one suitable embodiment, the opening 49 has a projected surface area (i.e., the area of the opening if it was projected onto a generally planar surface such as if viewed in the top plan of FIG. 6) that is more than one-forth but less than one-half of a projected surface area of the entire cover 11. In a more suitable embodiment, the projected surface area of the opening 49 is greater than about one-third but less than one-half of the total projected surface area of the cover. It is understood, however, that the projected surface area of the opening 49 can be more or less that illustrated without departing from some aspects of this invention.

Figure 7:
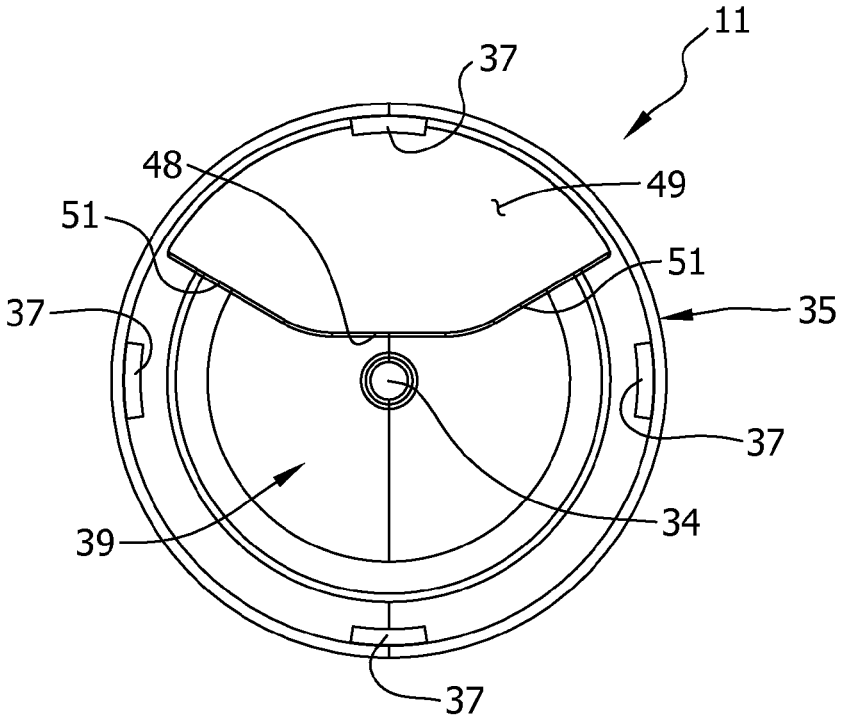
FIG. 7 is a bottom plan of the cover.

As illustrated in FIG. 7, the cover 11 has a plurality of internal tabs 37 extending outward from an interior surface of the peripheral skirt 35. The illustrated embodiment includes four internal tabs 37 but it is contemplated that more or fewer tabs can be provided. A generally cylindrical post 34, which is centrally located on the cover, extends downward from an interior surface of the upper portion 39 of the cover 11. The recess 41 in the upper portion 39 of the cover 11 is defined by the cylindrical post 34. It is contemplated that the cylindrical post 34 can be solid or have a closed top thereby eliminating the recess 41 in the upper portion 39 of the cover 11.

Figure 8:
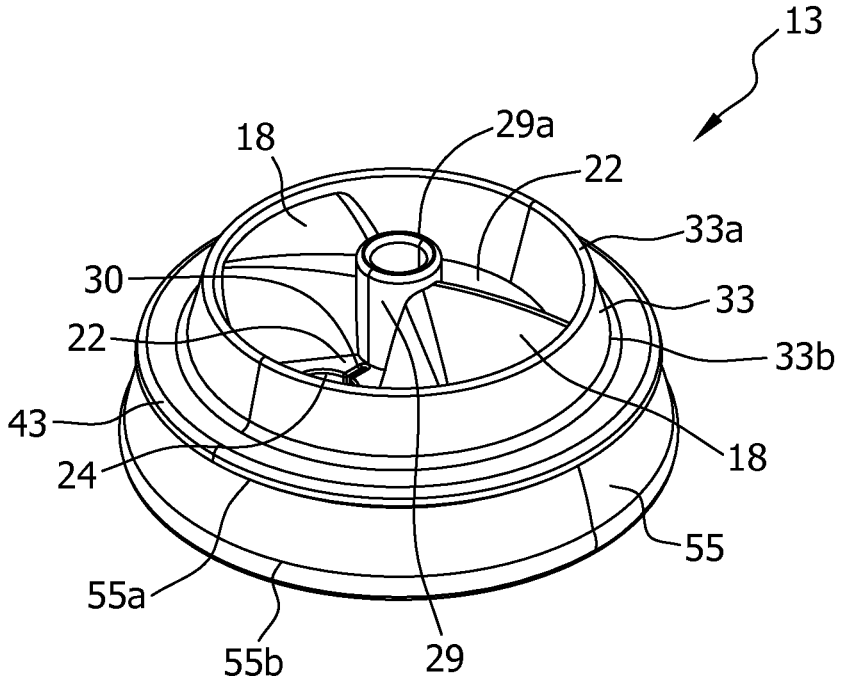
FIG. 8 is a perspective view of a closure member of the lid assembly.
Figure 9:
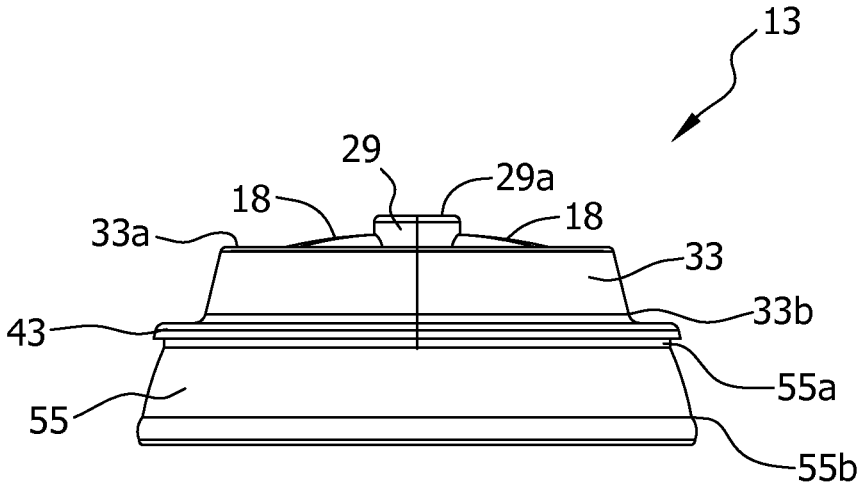
FIG. 9 is a side elevation of the closure member.
Figure 10:
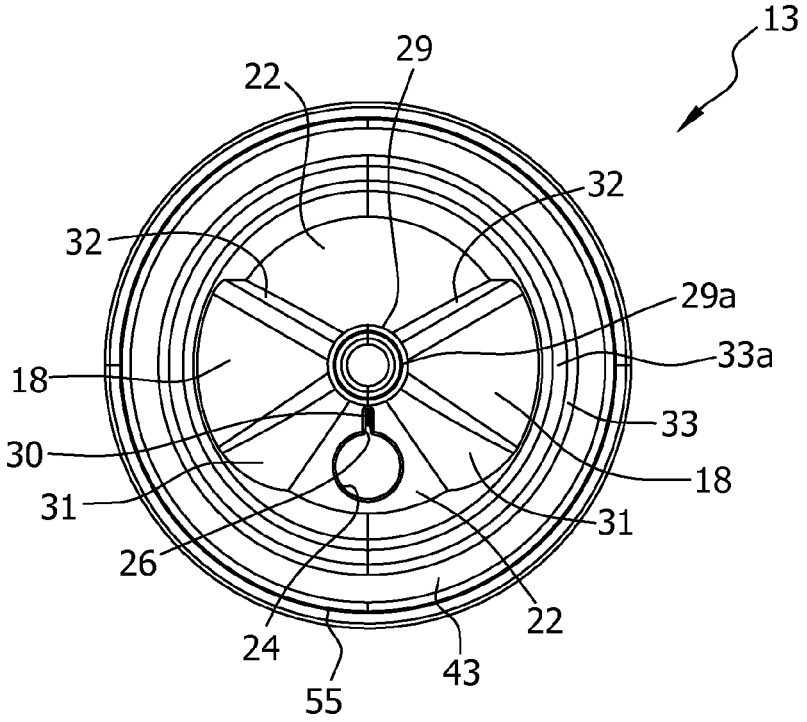
FIG. 10 is a top plan of the closure member.

With reference now to FIGS. 8-11, the closure member 13 of the lid assembly 9 comprises a cylindrical socket 29 sized and shaped for receiving the cylindrical post 34 of the cover 11 therein. As seen in FIG. 9, an upper edge 29*a* of the socket 29 extends beyond the other components of the closure member 13. With reference now to FIG. 10, a pair of raised portions 18 and a pair of lowered portions 22 are disposed adjacent the socket 29. Each of the raised portions 18 are spaced from the other by the lowered portions 22. One of the lowered portions 22 includes a circular opening 24, a notch 26 associated with the opening, and an elongate groove 30 associated with the notch. Tapered or sloped walls 31 extend between the lowered portion 22 having the opening 24 therein and each of the respective raised portions 18. Generally upright walls 32 extend between the lowered portion 22 without the opening 24 therein and the two adjacent raised portions 18.

As seen in FIG. 8, an annular upper wall 33 surrounds the upper and lower portions 18, 22 and is coaxially aligned with the socket 29. The upper wall 33 includes a first, free edge 33*a* and a lower edge 33*b*. A flange 43 extends outward from the upper wall 33 adjacent its lower edge 33*b*. An annular lower wall 55, which has a greater diameter than the diameter of the upper wall 33, extends downward from the flange 43. The lower wall 55 includes an upper groove 55*a* and a lower groove 55*b* spaced from the upper groove.

Figure 11:
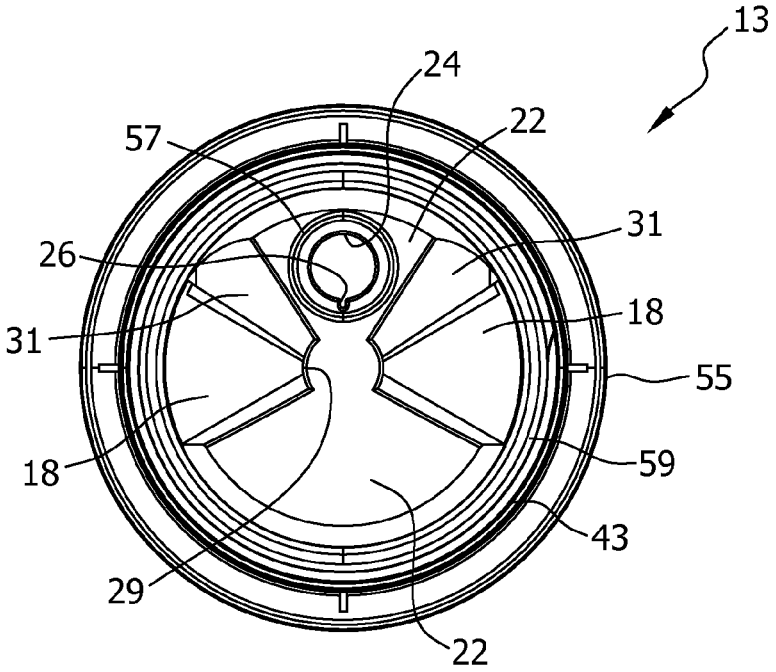
FIG. 11 is a bottom plan of the closure member.
Figure 12:
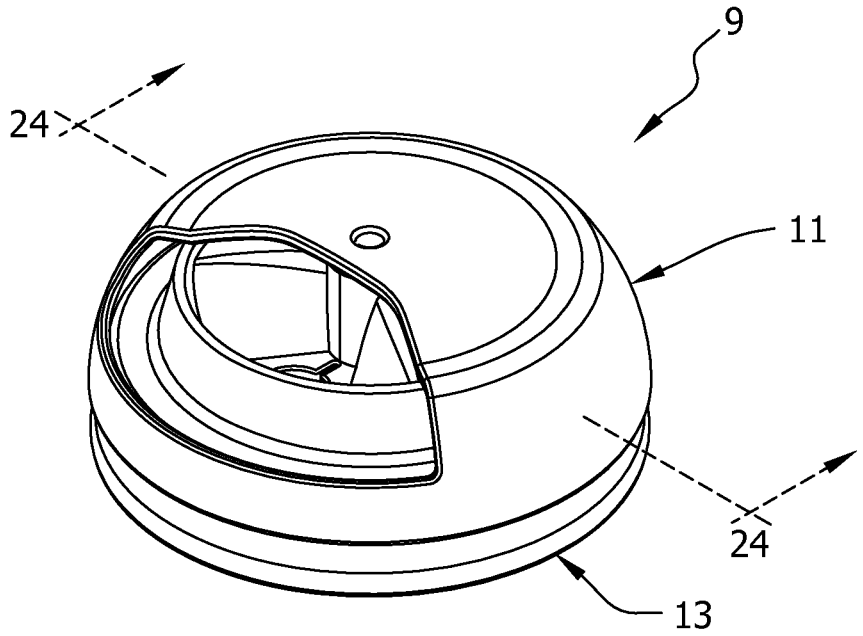
FIG. 12 is a perspective view of the lid assembly of the cup.
Figure 13:
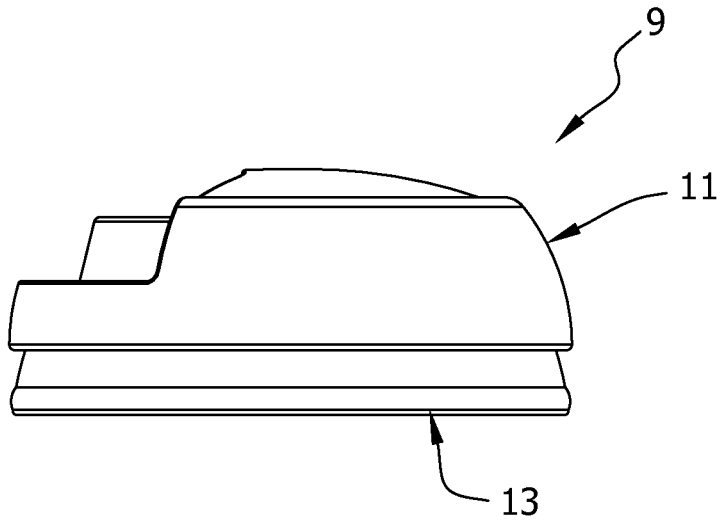
FIG. 13 is a side elevation of the lid assembly.
Figure 14:
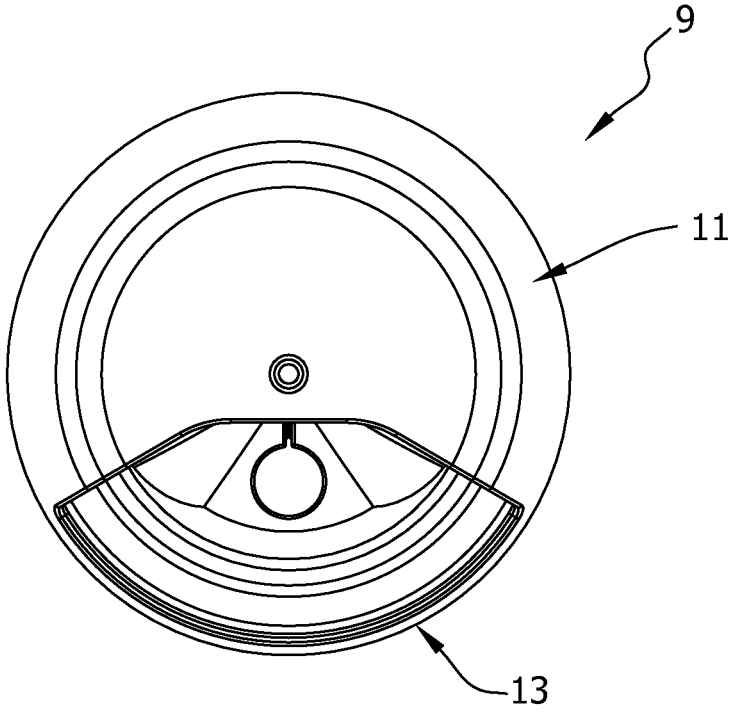
FIG. 14 is a top plan of the lid assembly.
Figure 15:
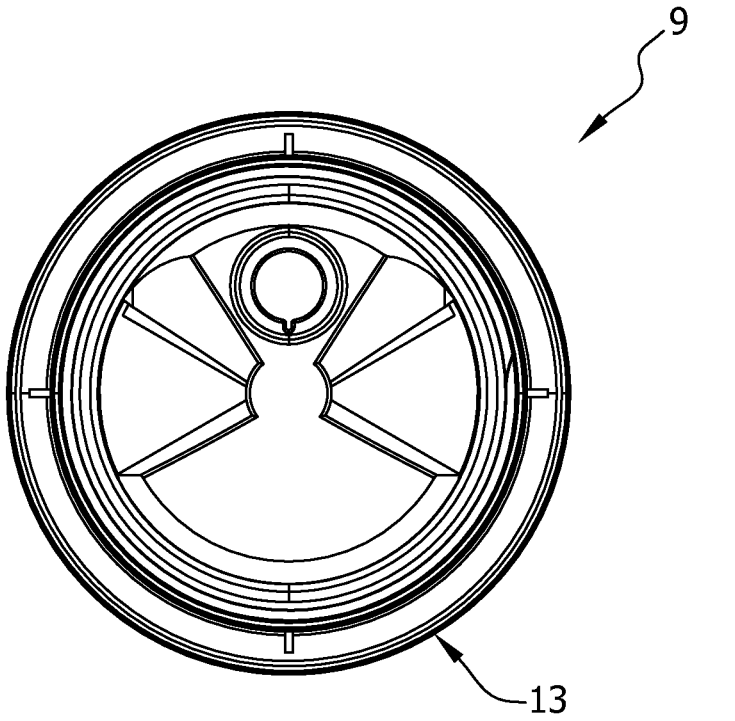
FIG. 15 is a bottom plan of the lid assembly.
Figure 16:
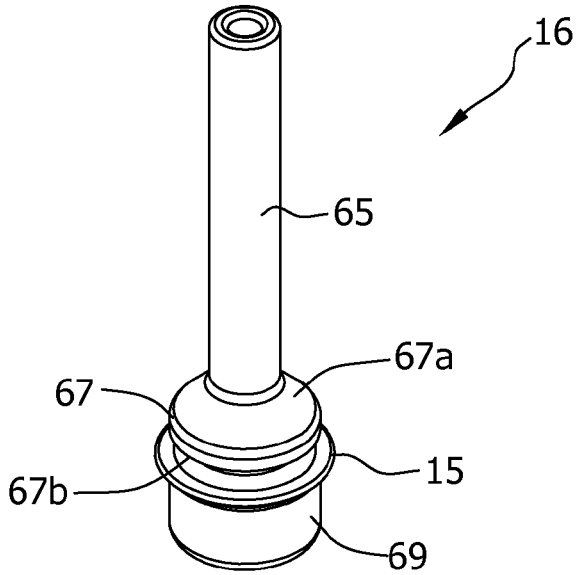
FIG. 16 is a perspective view of a straw assembly of the lid assembly.

As seen in FIG. 11, a circular flange 57 extends downward from the lower portion 22 having the opening 24 therein. The flange 57 is spaced from and surrounds the opening 24. The flange 57, notch 26, and groove 30 collectively define an air vent for venting the container 3 during use. Internal threads 59 are located on the lower wall 55 for mating with the external threads 27 of the attachment collar 23 of the container 3 and thereby releasably attach the lid assembly 9 to the container.

It is contemplated, however, that the lid assembly 9 can be releasably attached to the container 3 in any suitable manner.

The upper groove 55*a* of the lower wall 55 and the flange 43 collectively define a catch of the closure member 13 for capturing the tabs 37 of the cover 11. In the illustrated embodiment, the catch of the closure member 13 and the tabs 37 of the cover 11 have a non-releasable snap-fit connection with each other. Thus, the illustrated lid assembly 9 is not intended to be disassembled. That is, the cover 11 and closure member 13 of the illustrated embodiment are not releasably attached to each other (FIGS. 12-15). It is contemplated, however, that the cover 11 and closure member 13 can have a selectively releasable snap-fit connection with each other to facilitate the disassembly of the lid assembly 9.

Figure 17:
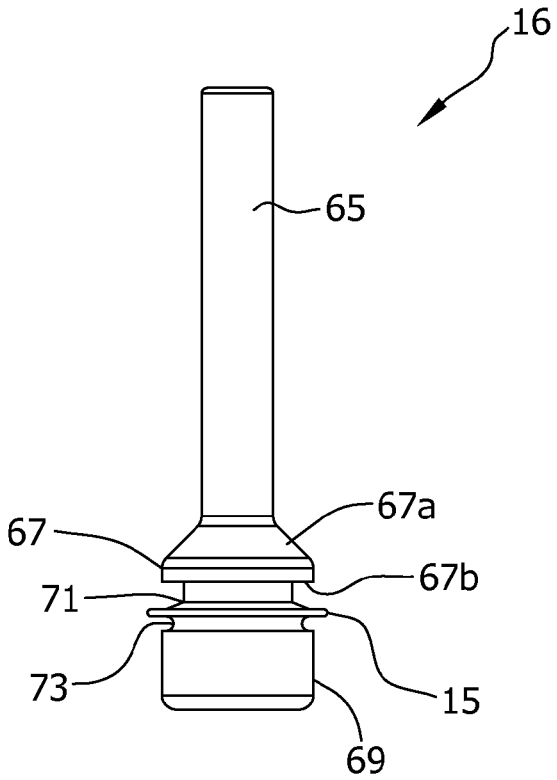
FIG. 17 is a side elevation of the straw assembly.
Figure 18:
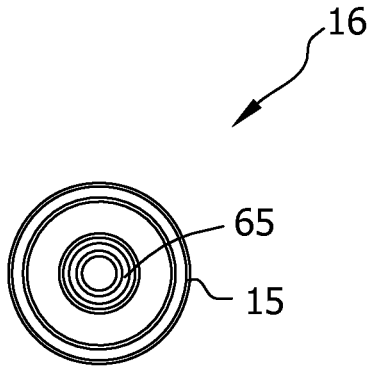
FIG. 18 is a top plan of the straw assembly.
Figure 19:
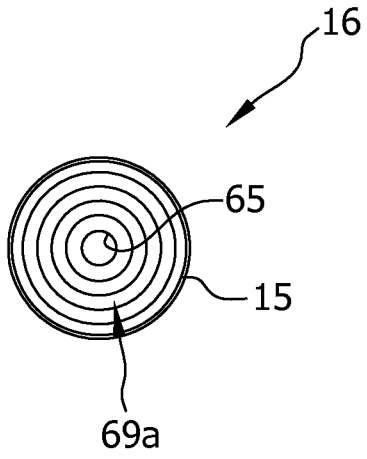
FIG. 19 is a bottom plan of the straw assembly.

As illustrated in FIGS. 16-19, the straw assembly 16 is elongate and includes an upper tubular portion 65 suitable for being partially received in the child's (or broadly, the user's) mouth for drawing liquid from the chamber 28 of the container 3. The straw assembly 16 further includes an upper mounting member 67, a generally ring-shaped diaphragm 15, and a lower mounting member 69. The upper mounting member 67 includes a tapered upper surface 67*a* and a generally flat lower surface 67*b*. The lower mounting member 69 includes a port 69*a* for selectively receiving a straw extension (not shown). The port 69*a* is suitably sized and shaped for frictionally securing the straw extension to the straw assembly 16. As seen in FIG. 17, a first groove 71 of the straw assembly 16 is disposed between the upper mounting member 67 and the diaphragm 15 and a second groove 73 is disposed between the diaphragm and the lower mounting member 69.

In one suitable embodiment, the straw assembly 16 is manufactured from a suitably pliable material so that the straw assembly can be resiliently deformed and passed through the opening 24 in the closure member 13. The straw assembly 16 is adapted to return to approximately its original shape after deformation and passing through the opening 24 to thereby mount the straw assembly to the closure member 13. More specifically, to mount the straw assembly 16 to the closure member 13 (or more broadly the lid assembly 9), the upper tubular portion 65 is inserted through the opening 24 in the closure member 13 from the underside (or bottom) of the closure member until the upper surface 67*a* of the upper mounting member 67 contact the closure member adjacent the opening. The upper tubular portion 65 has a diameter that is significantly smaller than the diameter of the opening 24 in the closure member 13 and, as a result, passes freely through the opening. The upper mounting member 67 has a larger diameter than the opening 24 and therefore has to be deformed to pass therethrough. The tapered upper surface 67*a* of the upper mounting member 67 provides a suitable sliding surface and thereby facilitates passing the upper mounting member through the opening 24. Upon passing the opening 24, the upper mounting member 67 resiliently returns to approximately its original shape.

Once the upper mounting member 67 passes through the opening 24, a portion of the closure member 13 adjacent the opening is captured in the first groove 71 of the straw assembly 9 between the upper mounting member 67 and the diaphragm 15. The generally flat surfaces of the lower surface 67*a* of the upper mounting member 67 and the diaphragm 15 provide some resistance to the straw assembly being pulled or otherwise decoupled from the closure member 13. It is understood, however, that the straw assembly can be decoupled from the closure member 13 be resiliently deforming the upper mounting member 67 and pulling the straw assembly 16 from engagement with the closure member. With the straw assembly 16 mounted on the closure member 13, the diaphragm sealingly engages with the circular flange 57 surrounding the opening in the closure member.

The illustrated drinking cup 1 can be repeatedly taken apart for thorough cleaning and reassembled for the next use. The separable components (as seen in FIG. 2) are all relatively large so that they are easy to handle, are not easily lost, and do not pose a danger to small children. In addition, the number of separable components is minimized to make assembly and reassembly of the cup 1 relatively easy. As mentioned above, the lid assembly 9, in the illustrated embodiment, can be removed from or secured to the container 3 via its threaded connection therewith. That is, the internal threads 59 of the closure member 13 can be engaged with and disengaged from the external threads 27 on the attachment collar 23 of the container 3. Other forms and structures for making a releasable connection between the lid assembly 9 and the container 3 may be used. For instance, the lid assembly may have a snap-fit connection with the container 3. As also mentioned above, the straw assembly 16 can be selectively coupled to and decoupled from the closure member 13 by inserting it and withdrawing if from the opening 24 in the closure member. Thus, all of the components (i.e., the container 3, lid assembly 9. and straw assembly 16) of the cup 1 can be easily separated, cleaned and reassembled.

Figure 20:
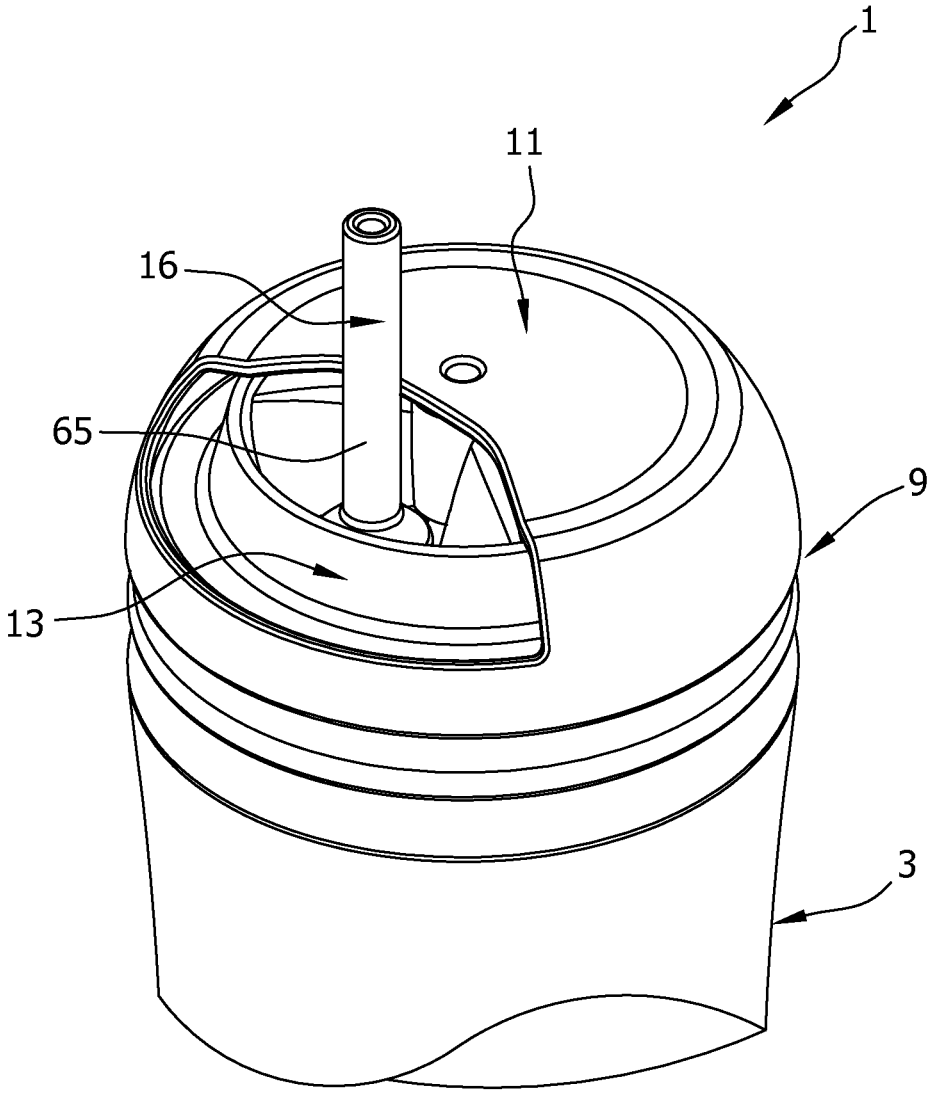
FIG. 20 is an enlarged, fragmentary perspective view of the cup with the straw assembly in its operative position on the lid assembly.

As illustrated in FIGS. 20-23, the straw assembly 16 can be selectively moved between an operative position (FIG. 20) wherein the upper tubular portion 65 of the straw assembly is generally straight and easily accessible to a user for drawing liquid from the container 3, and a stowed position (FIGS. 21-23) wherein the upper tubular portion 65 is bent to thereby pinch the straw assembly 16 closed. In its operative position, as seen in FIG. 20, a portion of the straw assembly 16 (i.e., the upper tubular portion 65 in the illustrated embodiment) projects upward through the large opening 49 in the cover 11. The upper tubular portion 65 of the straw assembly 16 extends a sufficient distance above or otherwise away from the upper portion 39 of the cover to facilitate the user of the cup 1 being able to take a portion of the straw assembly into their mouth for drinking.

Figure 21:
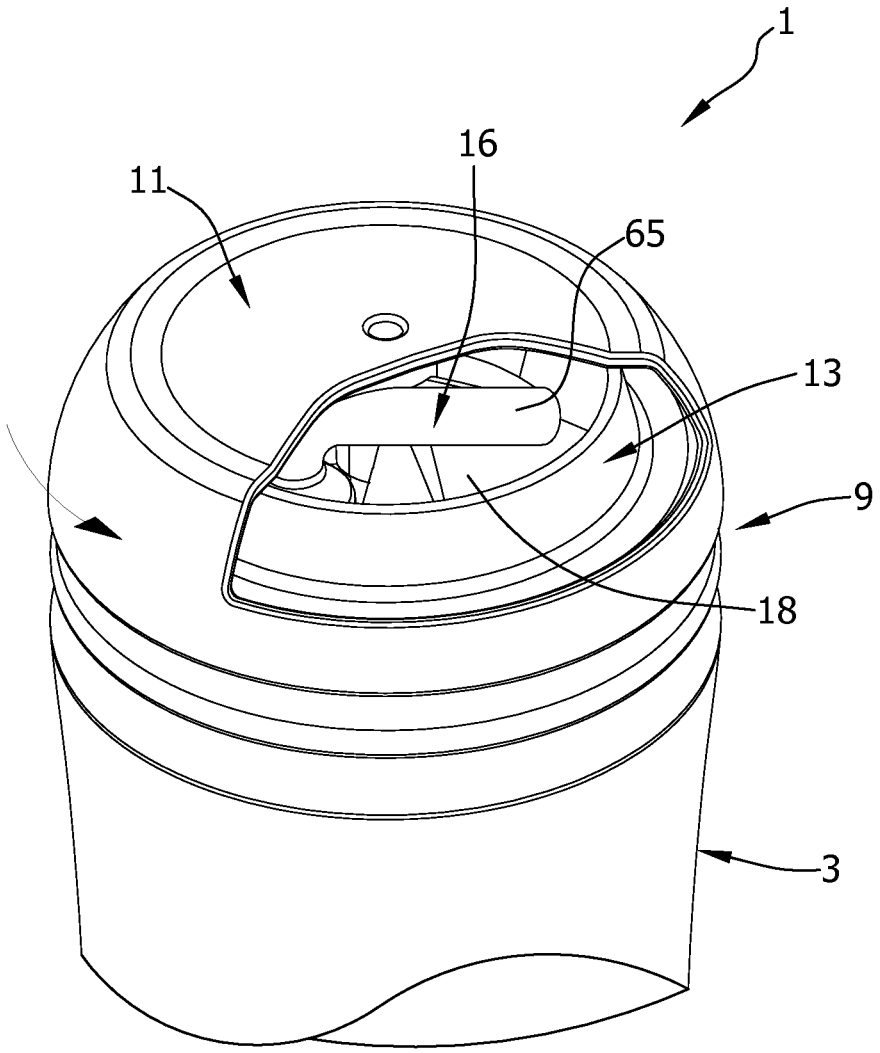
FIG. 21 is an enlarged, fragmentary perspective view of the cup with the straw assembly in its stowed position, the cover being rotated in a counter-clockwise direction.
Figure 22:
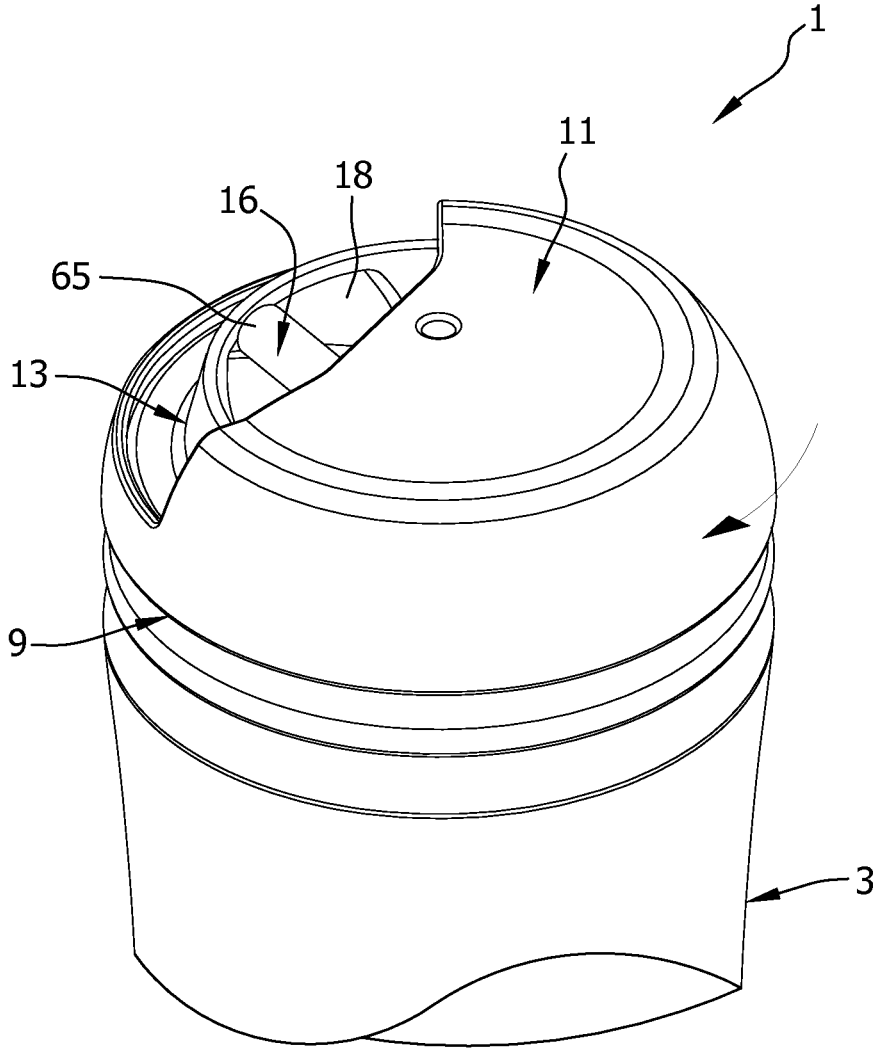
FIG. 22 is an enlarged, fragmentary perspective view of the cup with the straw assembly in its stowed position, the cover being rotated in a clockwise direction.
Figure 23:
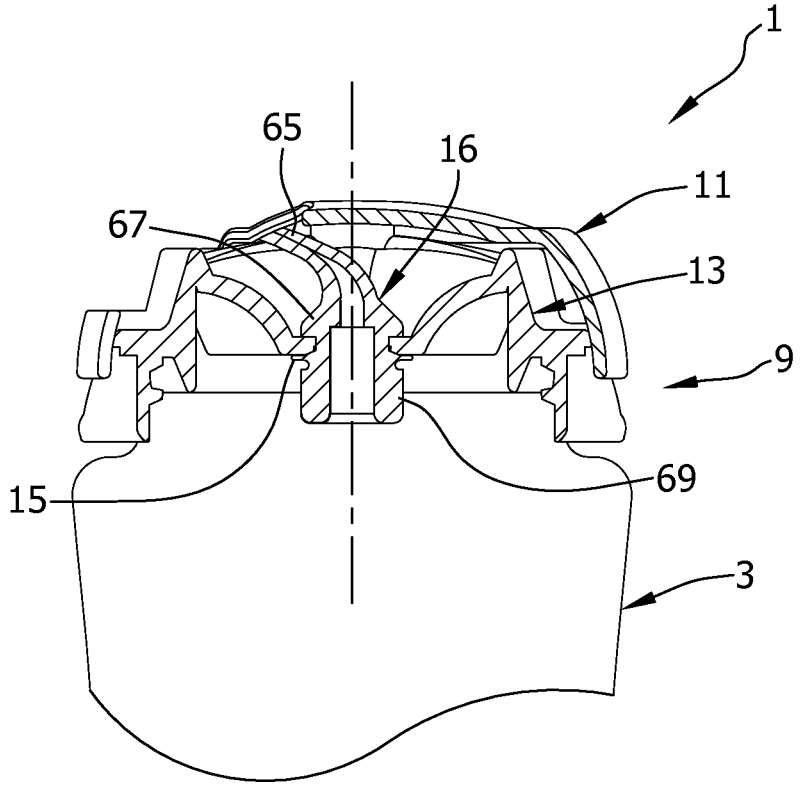
FIG. 23 is a fragmentary, vertical cross-section of the cup with the straw assembly in its stowed position.

The straw assembly can be moved from the operative position seen in FIG. 20 to its stowed position by rotating the cover 11 relative to the closure member 13 in either a counterclockwise direction (FIG. 21) or a clockwise direction (FIG. 22). As the cover 11 is rotated relative to the closure member 13 (regardless of the direction in which the cover is rotated), one of the second edge segments 51, which partially define the opening 49 through which the straw assembly extends, contacts the upper tubular portion 65 of the straw assembly and as the cover continues to rotate causes the upper tubular portion to bend about one of the tapered walls 31 of the closure member as illustrated in FIGS. 21 and 22. The bent over part of the upper tubular portion 65 of the straw assembly engages one of the upper portions 18 of the closure member 13 along a portion of its length. In other words, part of the upper portion 18 overlies, in directed contact therewith, one of the upper portions 18 of the closure member 13. The respective upper portion 18 of the closure member and the cover 11 collectively cooperate to pinch and hold pinched the part of the upper tubular portion 65 of the straw assembly 16 overlying the upper portion (FIG. 23). As a result, the straw assembly 16 is pinched closed along a portion of its length (and not just along a fold line).

Figure 24:
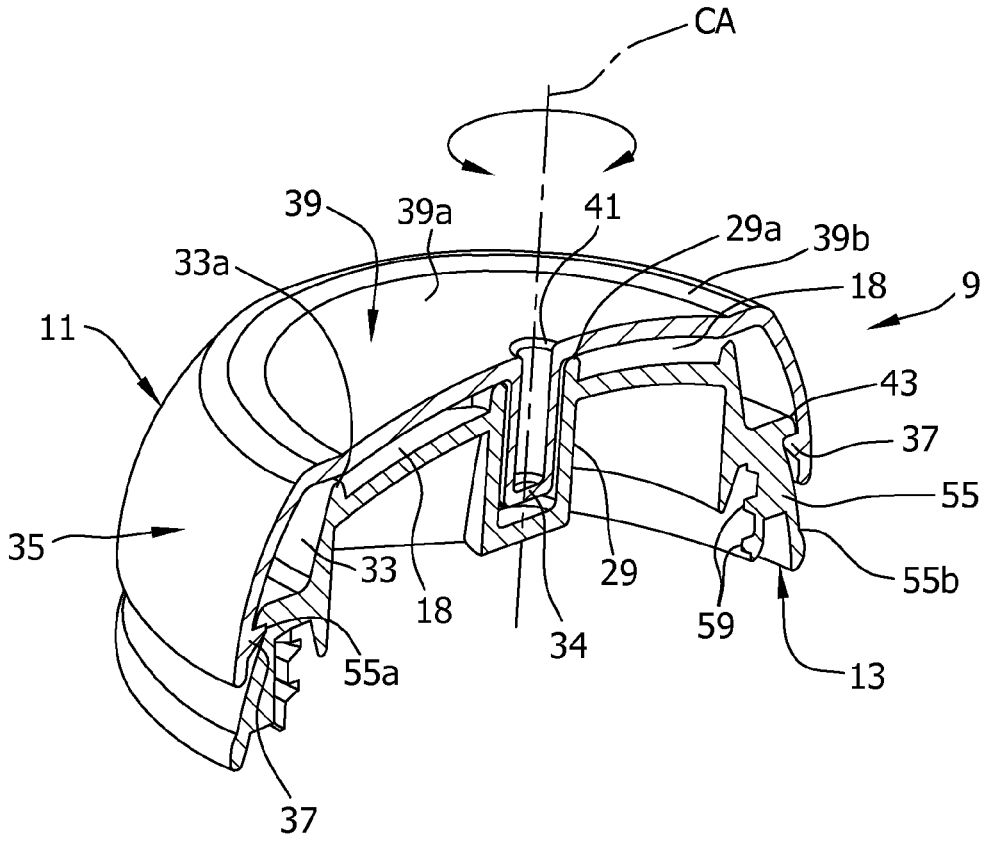
FIG. 24 is a fragmentary, vertical cross-section of the cup taken along line 24-24 of FIG. 12.

As illustrated in FIG. 24, the user of the cup 1 can easily rotate the cover 11 three hundred sixty degrees with respect to the closure member 13 about a central axis CA of the cup 1 and thereby move the straw assembly 16 between its operative and stowed positions. Rotation of the cover 11 is enabled by the interconnection of the cover with the closure member 13. The post 34 of the cover 11 is received in the socket of the closure member 13 and thereby provides a central pivot about which the cover can be rotated. Moreover, the surface contact area between the closure member 13 and the cover 11 is minimized. The upper edge 29*a* of the socket 29 of the closure member 13 contacts the interior surface of the domed part 39*a* of the cover 11 adjacent the post 34, and the free edge 33*a* of upper wall 33 of the closure member contacts the interior surface of the generally flat, annular part 39*b* of the cover. As a result, the points of contact and thereby the friction between the cover 11 and the closure member 13 is minimized. The socket 29 and the upper wall 33 of the closure member also act to keep the upper tubular portion 65 of the straw assembly 16 within the area of the respective raised portion 18 of the closure member when the straw assembly is in its stowed position. The tabs 37 of the cover 11 are able to slide relative to the catch of the closure member 13, which is defined by the upper groove 55*a* of the lower wall 55 and the flange 43, as the cover is rotated relative to the closure member. It is contemplated that one or more stops can be provided to inhibit the cover 11 from rotating three hundred sixty degrees with respect to the closure member 13.

It is easy for a young child (or any other user) to get a drink out of the cup 1 by placing her lips around the upper tubular portion 65 of the straw assembly 16 so as to form a seal with the straw assembly and sucking so that liquid in the container 3 is drawn up through the straw extension (not shown), the straw assembly, and into the child's mouth.

Figure 25:
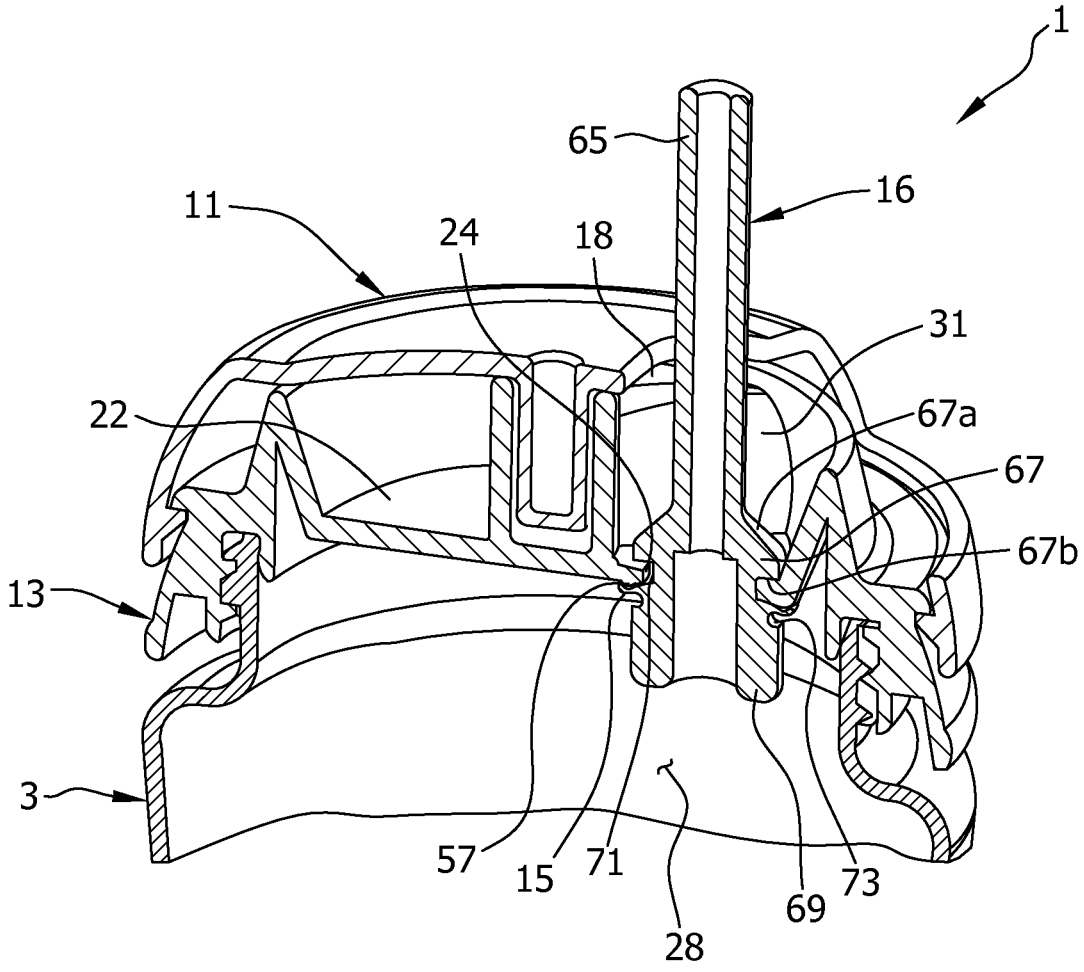
FIG. 25 is a fragmentary, vertical cross-section of the cup showing a diaphragm of the straw assembly in a sealed position.
Figure 26:
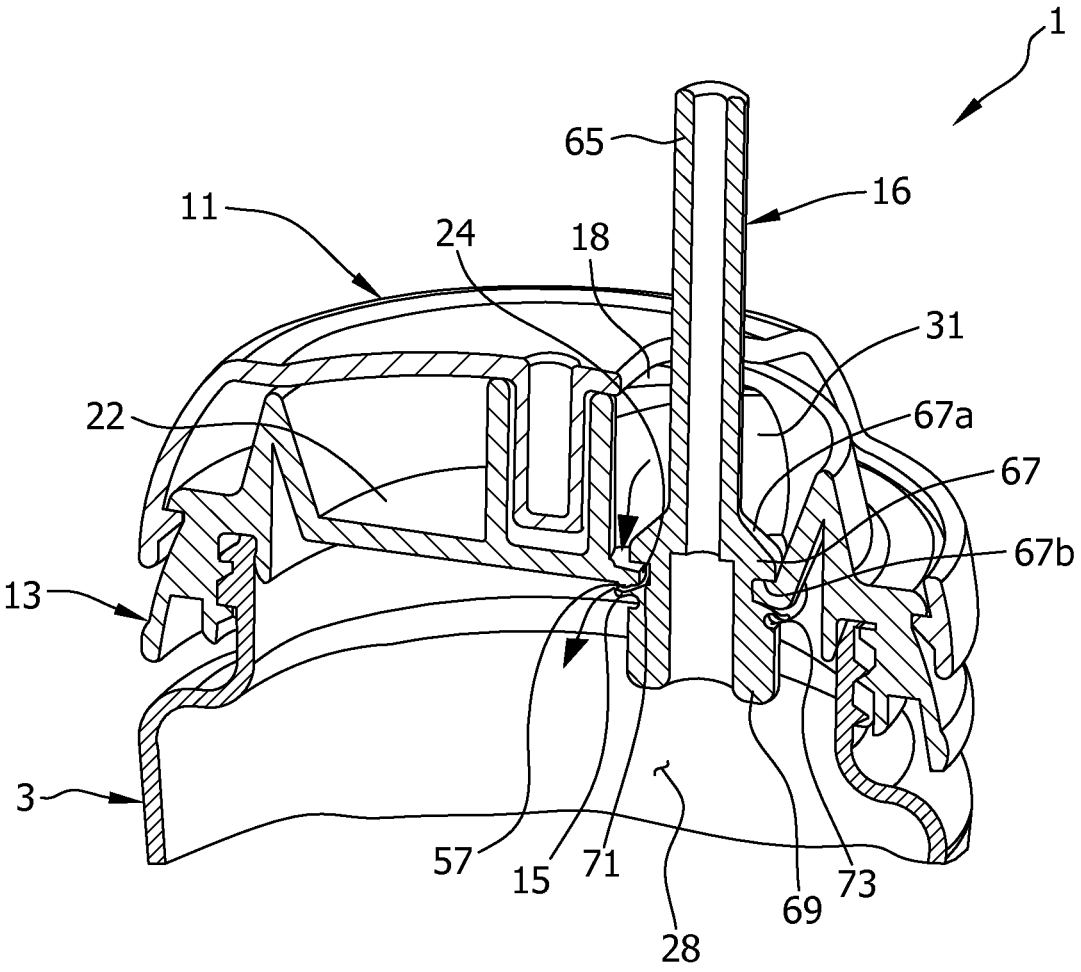
FIG. 26 is a fragmentary, vertical cross-section of the cup showing a diaphragm of the straw assembly in an unsealed position.

Sucking on the straw assembly 16 removes liquid and possibly air from within the liquid chamber 28 of the container 3 and thereby causes a vacuum within the liquid chamber. That is, sucking on the straw assembly 16 causes the pressure within the liquid chamber 28 of the container 3 to drop below ambient pressure. This drop in pressure causes the diaphragm 15 of the straw assembly to move from a sealed position (FIG. 25) to an unsealed position (FIG. 26). More specifically, the vacuum causes the diaphragm 15 to flex downward relative to the closure member 13 thereby opening the air vent and allowing air (as indicated by the arrows in FIG. 26) to flow through the groove 30 and notch 26 in the closure member 13 and into the liquid chamber 28 of the container 3. As the vacuum pressure within the liquid chamber 28 of the container 3 approaches ambient pressure, the resiliency of the diaphragm 15 causes it to move back to the sealed position (i.e., in sealing engagement with the flange 57) thereby closing the air vent.

Figure 27:
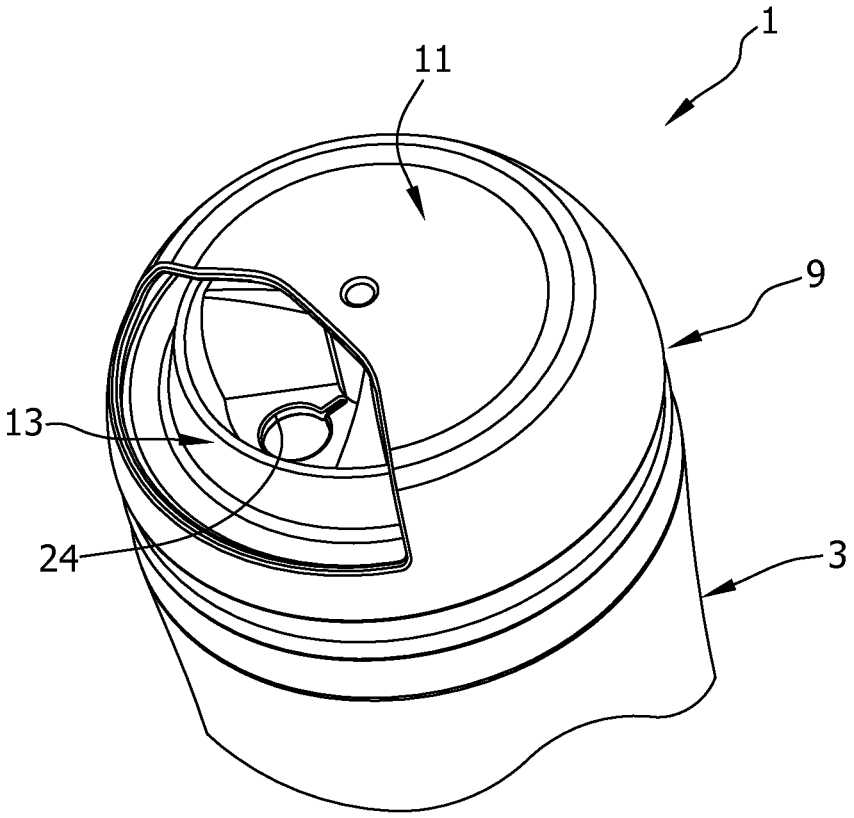
FIG. 27 is an enlarged, fragmentary perspective view of the cup with the straw assembly removed thereby converting the cup to a drinking cup.

FIG. 27 illustrates the cup 1 without the straw assembly 16. In this configuration, the cup 1 can be used in as a drinking cup. That is, the user can place her lips on the upper wall 33 of the closure member 13 adjacent the opening 24 therein and tilting the cup to causes liquid in the container 3 to flow through the opening and to the user's mouth. The opening 49 in the cover 11 is sufficiently large to thereby allow the user to drink from the cup 1 in this manner without interference from the cover. Thus, illustrated cup 1 is configurable between a drinking cup (FIG. 27) and a straw cup (FIGS. 1-26).

When introducing elements of the present invention or the various versions, embodiment(s) or aspects thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above without departing from the scope of the invention, it is intended that all matter contained in the above description and shown in the accompanying drawings shall be interpreted as illustrative and not in a limiting sense.

What is claimed is:

1. A lid assembly for closing a drinking container, the lid assembly comprising:

a closure member having a central axis, the closure member comprising a pair of substantially symmetric raised portions oriented diametrically opposite each other, a pair of lowered portions comprising a first lowered portion and a second lowered portion oriented diametrically opposite the first lowered portion, and a substantially upright annular upper wall coaxial with the central axis, the upright annular wall surrounding the raised and the lowered portions, the upright annular wall having an upper free edge, the first lowered portion having a circular opening therein, the second lowered portion being free from openings, the closure member having a sloped wall extending between the first lowered portion and each of the respective raised portions, and a generally upright wall extending between the second lowered portion and each of the respective raised portions; and a cover secured to the closure member, the cover having an opening therein, the opening having an upper edge located in an upper surface of the cover and a lower edge located below the upper free edge of the annular upper wall, wherein the cover is capable of rotating greater than 360 degrees in a clockwise direction and greater than 360 degrees in a counter-clockwise direction relative to the closure member while the cover is secured to the closure member.

2. The lid assembly as set forth in claim 1 wherein the closure member has a socket and the cover has a post received in the socket, the post defining a pivot axis about which the cover can rotate with respect to the closure member.

3. The lid assembly as set forth in claim 2 wherein the socket includes an upper edge, the upper free edge of the upper wall and the upper edge of the socket being spaced apart and contacting an interior surface of the cover.

4. The lid assembly as set forth in claim 1 in combination with the drinking container, the lid assembly being releasably attachable to the container.

5. A lid assembly for closing a drinking container, the lid assembly comprising:

a closure member having a central axis, the closure member having a pair of substantially symmetric raised portions oriented diametrically opposite each other, a pair of lowered portions oriented diametrically opposite each other, the closure member comprising an annular upper wall having an upper free edge, the annular upper wall being coaxial with the central axis and surrounding the raised and lowered portions; and a cover secured to the closure member, the cover comprising an upper domed portion coaxial with the central axis, a generally flat annular portion surrounding the domed portion, the flat annular portion extending radially outward from and substantially perpendicular to the central axis, and a peripheral skirt extending downward from the flat annular portion, the flat annular portion in direct contact with the upper free edge of the annular upper wall, the cover including an opening therein, the opening having an upper edge segment located in the upper domed portion and a lower edge segment located in the peripheral skirt, wherein the opening has a projected surface area that is more than one-fourth but less than one-half of a projected surface area of the entire cover.

6. The lid assembly as set forth in claim 5 wherein the projected surface area of the opening in the cover is more than about one-third but less than one-half of the projected surface area of the entire cover.

7. The lid assembly as set forth in claim 5 wherein the cover includes at least one tab and the closure member includes a groove for receiving the at least one tab of the cover, the at least one tab of the cover being slidably received within the groove.

8. The lid assembly as set forth in claim 7 wherein the cover is non-releasably connected to the closure member when the at least one tab is received within the groove.

9. The lid assembly as set forth in claim 5 in combination with the container, the lid assembly being releasably attachable to the container.

10. A lid assembly for closing a drinking container, the lid assembly comprising:

a central axis;

a closure member having a central axis, the closure member having a pair of substantially symmetric raised portions oriented diametrically opposite each other, a pair of lowered portions oriented diametrically opposite each other, a socket coaxial with the central axis, the socket including an upper edge, and an annular upper wall concentric with the socket, the annular upper wall including an upper free edge, each of the raised portions and the lowered portions extending between the socket and the upper annular wall, each of the raised portions being spaced from the other by and being formed adjacent each of the lowered portions, one of the lowered portions having a circular opening therein, each of the raised portions having a sloped wall extending between the lowered portion having the opening therein and each of the respective raised portions; and a cover having a post received in the socket, the cover further having an opening therein, the opening having a lower edge located below the upper free edge of the annular upper wall, wherein the post defines a pivot axis about which the cover can rotate with respect to the closure member, the cover being capable of rotating greater than 360 degrees in a clockwise direction and greater than 360 degrees in a counter-clockwise direction relative to the closure member while the cover is secured to the closure member, the pivot axis and the central axis being coaxial, and wherein the upper free edge of the upper annular wall and the upper edge of the socket are spaced apart and contact an interior surface of the cover, the upper edge of the socket extending upward beyond the upper free edge of the upper annular wall.

11. The lid assembly as set forth in claim 10 in combination with a container, the lid assembly being releasably attachable to the container.

12. The lid assembly as set forth in claim 1 further comprising a straw assembly selectively attachable to and detachable from the closure member.

13. The lid assembly as set forth in claim 5 further comprising a straw assembly selectively attachable to and detachable from the closure member.

14. The lid assembly as set forth in claim 10 further comprising a straw assembly selectively attachable to and detachable from the closure member.

* * * * *